US009177771B2

(12) United States Patent
Baba

(10) Patent No.: US 9,177,771 B2
(45) Date of Patent: Nov. 3, 2015

(54) METHOD AND APPARATUS FOR IMPROVED SENSITIVITY IN A MASS SPECTROMETER

(71) Applicant: DH Technologies Development Pte. Ltd., Singapore (SG)

(72) Inventor: Takashi Baba, Richmond Hill (CA)

(73) Assignee: DH Technologies Development Pte. Ltd, Singapore (SG)

( * ) Notice: Subject to any disclaimer, the term of this patent is extended or adjusted under 35 U.S.C. 154(b) by 0 days.

(21) Appl. No.: 14/368,703

(22) PCT Filed: Nov. 28, 2012

(86) PCT No.: PCT/IB2012/002529

§ 371 (c)(1),
(2) Date: Jun. 25, 2014

(87) PCT Pub. No.: WO2013/098602

PCT Pub. Date: Jul. 4, 2013

(65) Prior Publication Data

US 2014/0374588 A1 Dec. 25, 2014

Related U.S. Application Data

(60) Provisional application No. 61/581,349, filed on Dec. 29, 2011.

(51) Int. Cl.

| | |
|---|---|
| ***H01J 49/00*** | (2006.01) |
| ***H01J 49/06*** | (2006.01) |
| ***H01J 49/36*** | (2006.01) |

(52) U.S. Cl.

CPC ..... *H01J 49/063* (2013.01); *H01J 49/062* (2013.01); *H01J 49/36* (2013.01)

(58) Field of Classification Search

USPC ..... 250/283

See application file for complete search history.

(56) References Cited

U.S. PATENT DOCUMENTS

| | | | | |
|---|---|---|---|---|
| 6,423,965 | B1 * | 7/2002 | Hashimoto et al. | 250/288 |
| 6,781,117 | B1 * | 8/2004 | Willoughby et al. | 250/281 |
| 7,256,395 | B2 | 8/2007 | Collings et al. | |
| 7,259,371 | B2 | 8/2007 | Collings et al. | |
| 7,868,289 | B2 * | 1/2011 | Cousins et al. | 250/292 |
| 8,373,120 | B2 * | 2/2013 | Verentchikov | 250/290 |
| 2003/0183759 | A1 | 10/2003 | Schwartz et al. | |
| 2006/0289746 | A1 | 12/2006 | Raznikov et al. | |
| 2009/0321624 | A1 | 12/2009 | Fang et al. | |
| 2011/0133079 | A1 | 6/2011 | Cousins et al. | |

FOREIGN PATENT DOCUMENTS

| | | | |
|---|---|---|---|
| EP | 2254142 | A2 | 11/2010 |

* cited by examiner

*Primary Examiner* — Phillip A Johnston

(57) ABSTRACT

A method and apparatus is provided including an ion source for generating ions, a vacuum chamber having an inlet aperture for receiving ions and an exit aperture for passing ions from the vacuum chamber. At least one ion guide is provided between the inlet and exit apertures, the at least one ion guide having an entrance end and an exit end. The at least one ion guide having an inner cylinder and an outer cylinder. The inner cylinder having a plurality of sections, each section having a different number of slots and the inner cylinder coaxially disposed within the outer cylinder wherein the inner cylinder is configured to generate more than one multipole field. A power supply is provided for providing an RF voltage between the outer and inner cylinders.

20 Claims, 7 Drawing Sheets

42: outer cylinder, 40: inner cylinder, 48: rf voltage source, 50: additional quadrupole electrodes

METHOD AND APPARATUS FOR IMPROVED SENSITIVITY IN A MASS SPECTROMETER

RELATED APPLICATION

This application claims the benefit and priority of U.S. Provisional Application Ser. No. 61/581,349, filed on Dec. 29, 2011, the entire contents of which is herein incorporated by reference.

FIELD

The applicant's teachings relate to a method and apparatus for improved sensitivity in a mass spectrometer, and more specifically to ion guides for transporting ions.

INTRODUCTION

In mass spectrometry, sample molecules are converted into ions using an ion source, in an ionization step, and then detected by a mass analyzer, in mass separation and detection steps. For most atmospheric pressure ion sources, ions pass through an inlet aperture prior to entering an ion guide in a vacuum chamber. The ion guide transports and focuses ions from the ion source into a subsequent vacuum chamber, and a radio frequency voltage can be applied to the ion guide to provide radial focusing of ions within the ion guide. However, during transportation of the ions through the ion guide, ion losses can occur. Therefore, it is desirable to increase transport efficiency of the ions along the ion guide and prevent the loss of ions during transportation to attain high sensitivity.

SUMMARY

In view of the foregoing, the applicant's teachings comprise a mass spectrometer system. In various aspects, the system comprises an ion source for generating ions from a sample and a vacuum chamber comprising an inlet aperture for receiving the ions, and an exit aperture for passing ions from the vacuum chamber. In various embodiments, the system comprises at least one ion guide between the inlet and exit apertures, the at least one ion guide having an entrance end and an exit end. In various aspects, the at least one ion guide comprises an inner cylinder and an outer cylinder, the inner cylinder having a plurality of sections, each section comprising a plurality of slots in the inner cylinder and each of the plurality of sections of the inner cylinder comprises a different number of slots. In various aspects, the inner cylinder can be coaxially disposed within the outer cylinder, wherein the inner cylinder can be configured to generate more than one multipole RF field. In various aspects, the system comprises a power supply for providing an RF voltage between the outer and inner cylinders for radially confining the ions within the inner cylinder of the at least one ion guide. In various aspects, the plurality of slots can be suitably spaced to generate the desired more than one multipole field. In various embodiments, the number of slots is determined by n/2, where n is the order of the multipole RF field generated. In various aspects, the number of slots in the plurality of sections of the inner cylinder can be selected from the group consisting of two slots to generate a quadrupole electric field, three slots to generate a hexapole electric field, four slots to generate an octopole electric field, and any combinations thereof. In various embodiments, the plurality of sections of the inner cylinder comprise a first section and a second section, each section having a plurality of slots for generating the more than one multipole RF field. In various aspects, the first section comprises four slots to generate an octopole field, and the second section comprises two slots to generate a quadrupole field. In various embodiments, the outer cylinder comprises a mesh. In various aspects, the plurality of slots can be suitably sized to generate the desired more than one multipole field. In various aspects, a section of the inner cylinder near the exit end of the at least one ion guide further comprises additional quadrupole electrodes to generate a stronger quadrupole field.

A method for transmitting ions is provided. In various aspects, the method comprises providing an ion source for generating ions from a sample. In various embodiments, the method includes providing a vacuum chamber comprising an inlet aperture for receiving the ions, and an exit aperture for passing ions from the vacuum chamber. In various aspects, at least one ion guide is provided between the inlet and exit apertures, and the at least one ion guide can have an entrance end and an exit end. In various embodiments, the at least one ion guide comprises an inner cylinder and an outer cylinder. In various aspects, the inner cylinder can have a plurality of sections, each section comprising a plurality of slots in the inner cylinder, and each of the plurality of sections of the inner cylinder comprises a different number of slots. In various aspects, the inner cylinder can be coaxially disposed within the outer cylinder, wherein the inner cylinder is configured to generate more than one multipole RF field. In various embodiments, the method comprises providing a power supply for providing an RF voltage between the outer and inner cylinders for radially confining the ions within the inner cylinder of the at least one ion guide.

In various aspects, the spacing between the plurality of slots can be suitably spaced to generate the desired more than one multipole field. In various embodiments, the number of slots is determined by n/2, where n is the order of the multipole RF field generated. In various aspects, the number of slots in the plurality of sections of the inner cylinder can be selected from the group consisting of two slots to generate a quadrupole electric field, three slots to generate a hexapole electric field, four slots to generate an octopole electric field, and any combinations thereof. In various embodiments, the plurality of sections of the inner cylinder comprise a first section and a second section, each section having a plurality of slots for generating the more than one multipole RF field. In various aspects, the number of slots in the first section differs from the number of slots in the second section. In various embodiments, the first section comprises four slots to generate an octopole field, and the second section comprises two slots to generate a quadrupole field. In various aspects, the outer cylinder can be meshed. In various aspects, the plurality of slots can be suitably sized to generate the desired more than one multipole field. In various aspects, a section of the inner cylinder near the exit end of the at least one ion guide further comprises additional quadrupole electrodes to generate a stronger quadrupole field.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

In the drawings, like reference numerals indicate like parts.

DESCRIPTION OF VARIOUS EMBODIMENTS

Figure 1:
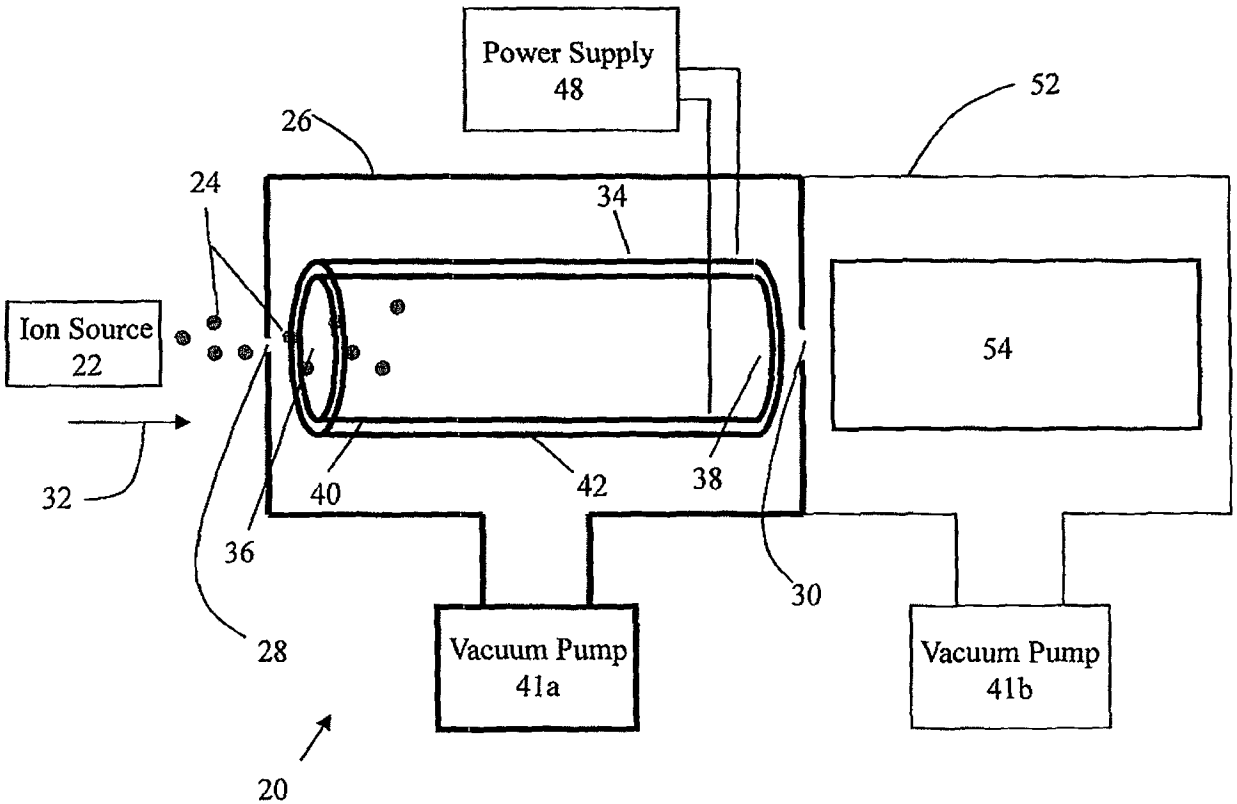
FIG. 1 is a schematic view of a mass spectrometer system according to various embodiments of the applicant's teachings.

It should be understood that the phrase "a" or "an" used in conjunction with the applicant's teachings with reference to various elements encompasses "one or more" or "at least one" unless the context clearly indicates otherwise. In various aspects, a mass spectrometry system and a method for transmitting ions is provided. Reference is first made to FIG. 1, which shows schematically a mass spectrometry system 20 according to various embodiments of the applicant's teachings. In various embodiments, the system 20 comprises an ion source 22 for generating ions 24 from a sample of interest, not shown. In various aspects, the ions 24 can travel towards a vacuum chamber 26, in the direction indicated by the arrow 32. In various aspects, a vacuum pump 41*a* can provide suitable vacuum to vacuum chamber 26. In various embodiments, the vacuum chamber 26 can further comprise an exit aperture 30 located downstream from the inlet aperture 28 for passing ions 24 from the vacuum chamber 26. In various aspects, the exit aperture 30 can separate the vacuum chamber 26, also known as the first vacuum chamber, from the next or second vacuum chamber 52 which can house a mass analyzer 54, as exemplified in FIG. 1, or a further ion guide 56, as exemplified in FIG. 7. In various aspects, a vacuum pump 41*b* can provide suitable vacuum to vacuum chamber 52. In various aspects, the system 20 can comprise at least one ion guide 34. In various embodiments, the at least one ion guide 34 can be positioned between the inlet aperture 28 and the exit aperture 30 for radially confining, focusing and transmitting the ions 24. In various embodiments, the at least one ion guide 34 can comprise an entrance end 36 and an exit end 38. In various embodiments, the at least one ion guide 34 can comprise an inner cylinder 40 and an outer cylinder 42.

Figure 2:
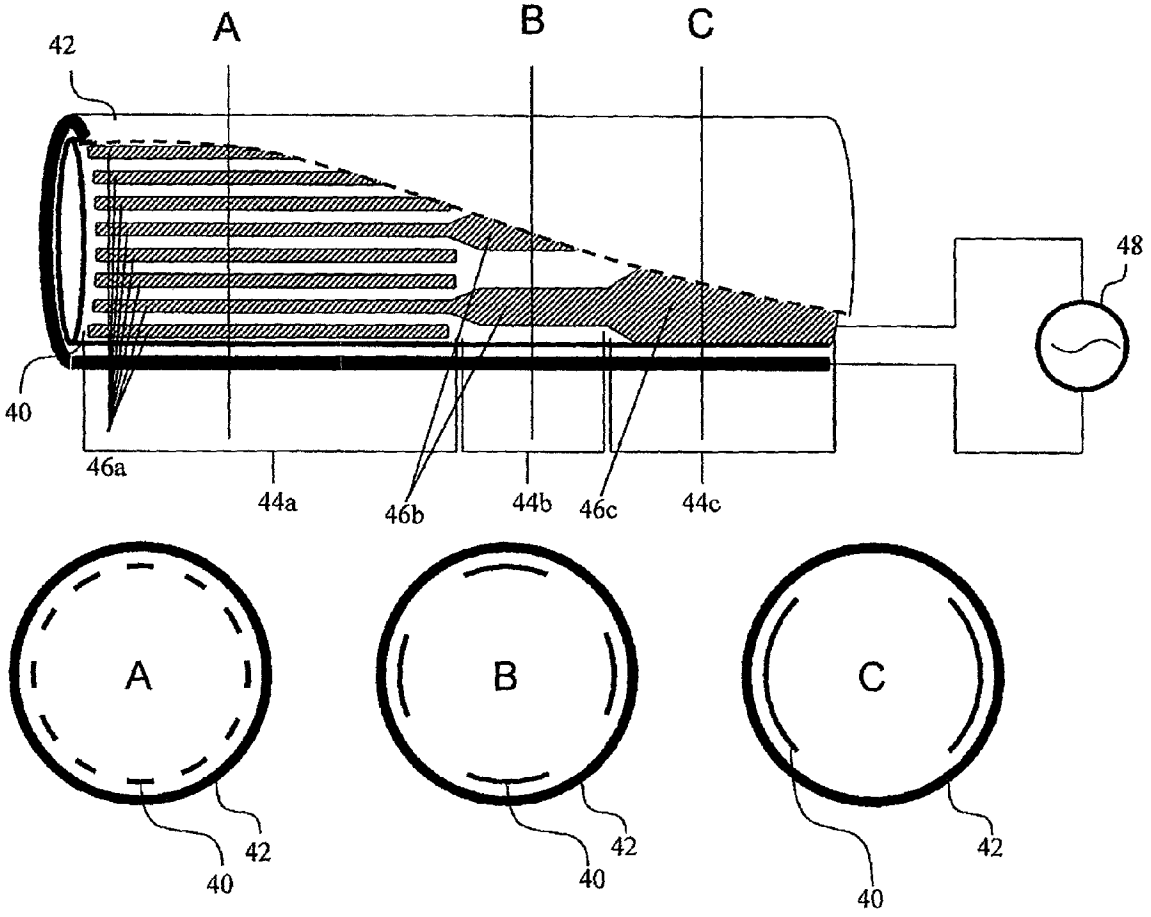
FIG. 2 is a cross-sectional view of an ion guide of the embodiment of FIG. 1 according to various embodiments of the applicant's teachings.

In various aspects, the inner cylinder 40 can comprise a plurality of sections 44*a*, 44*b*, etc., as exemplified in FIG. 2. In various embodiments, each of the plurality of sections 44 of the inner cylinder 40 can comprise a different number of slots 46*a*, 46*b*, etc. For example, FIG. 2 shows a cross-section of the ion guide 34 of FIG. 1 in which inner cylinder 40 comprises sections, 44*a*, 44*b*, and 44*c*. Each of the sections can have a different number of slots. For example, as exemplified in FIG. 2, sections 44*a*, 44*b* and 44*c* have a different number of slots, 46*a*, 46*b* and 46*c*, represented by the shaded areas.

In various aspects, each section 44 of the inner cylinder 40 can comprise any number of slots. In various aspects, the surface of the inner cylinder can be machined to form the slots. In various embodiments, the slots can be suitably spaced to form the slots to generate the desired multipole RF fields. In various embodiments, the inner cylinder 40 can be coaxially disposed within the outer cylinder 42, as shown in FIGS. 1 and 2, to generate more than one multipole RF field. In various embodiments, the distance between the outer and inner cylinders can be less than the width of the slots. In various embodiments, the distance between the outer and inner cylinders can be about 1 mm. In various embodiments, the thickness of the inner cylinder can be less than the width of the slots. In various embodiments, the thickness of the inner cylinder can be about 0.5 mm to about 1 mm. In various embodiments, the minimum width of the slot can be about 1 mm. In various embodiments, the distance between the outer and inner cylinders can be less than the width of the slots. The thickness of the inner cylinder can be less than the width of the slots. Then, in various embodiments, the thickness of the inner cylinder can be about 0.5 to about 1 mm, the minimum width of the slot can be 1 mm. In various embodiments, a power supply 48 can provide an RF voltage between the outer cylinder 42 and the inner cylinder 40 for radially confining the ions within the inner cylinder 40 of the at least one ion guide 34. In various embodiments, a DC potential can also be applied between the outer cylinder 42 and the inner cylinder 40.

In various embodiments, the number of slots in each section of the inner cylinder can be determined by n/2, where n is the order of the multipole RF field generated. Various multipole fields can be generated. For example, where there are twelve slots in the inner cylinder, a $24^{th}$ pole electric field can be generated, four slots can form an octapole electric field, and two slots can form a quadrupole field. In various aspects, the number of slots in the plurality of sections of the inner cylinder can be selected from the group consisting of two slots to generate a quadrupole electric field, three slots to generate a hexapole electric field, four slots to generate an octopole electric field, and any combinations thereof.

Figure 3:
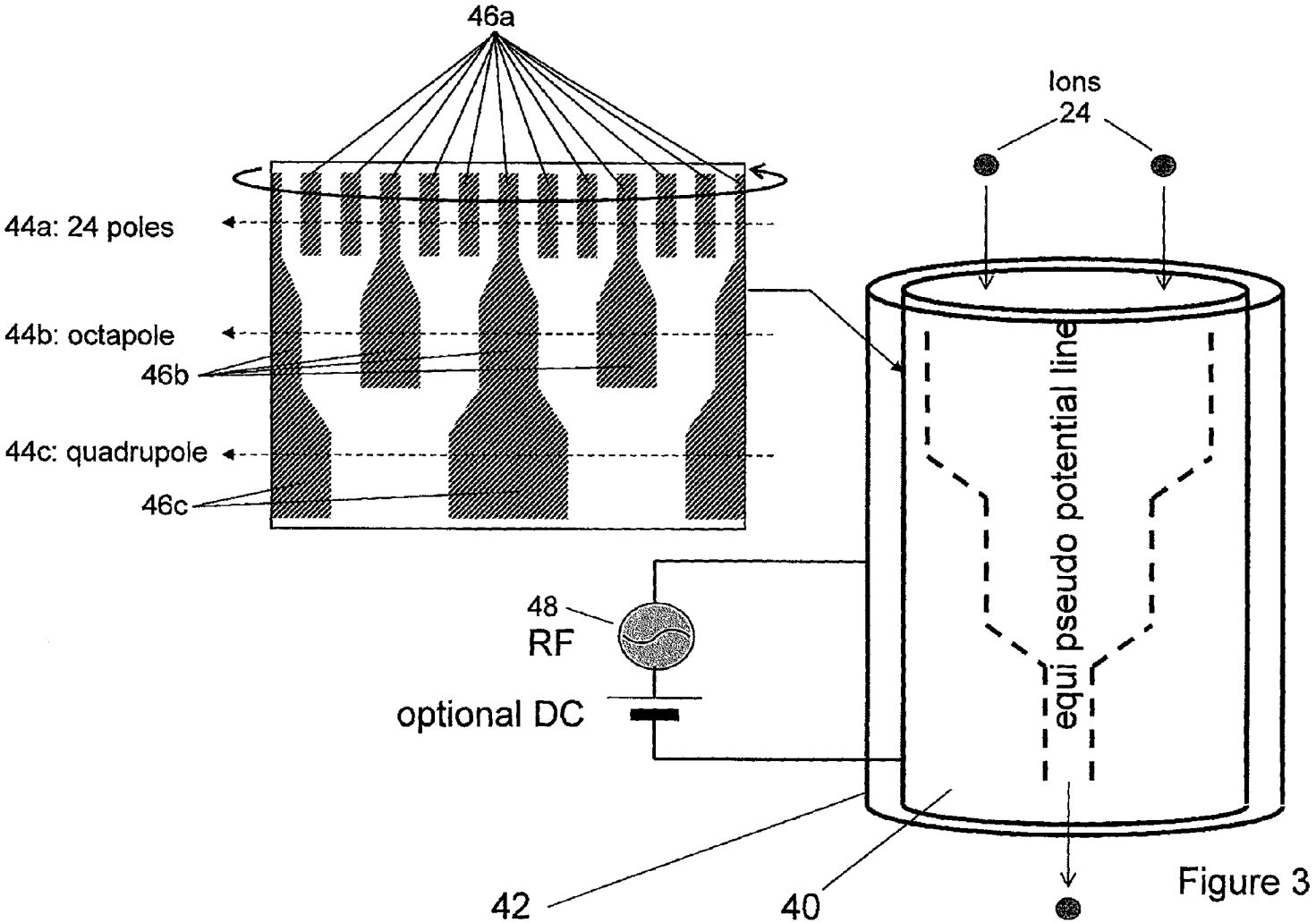
FIG. 3 is a cross-sectional view of an ion guide according to various embodiments of the applicant's teachings
Figure 4:
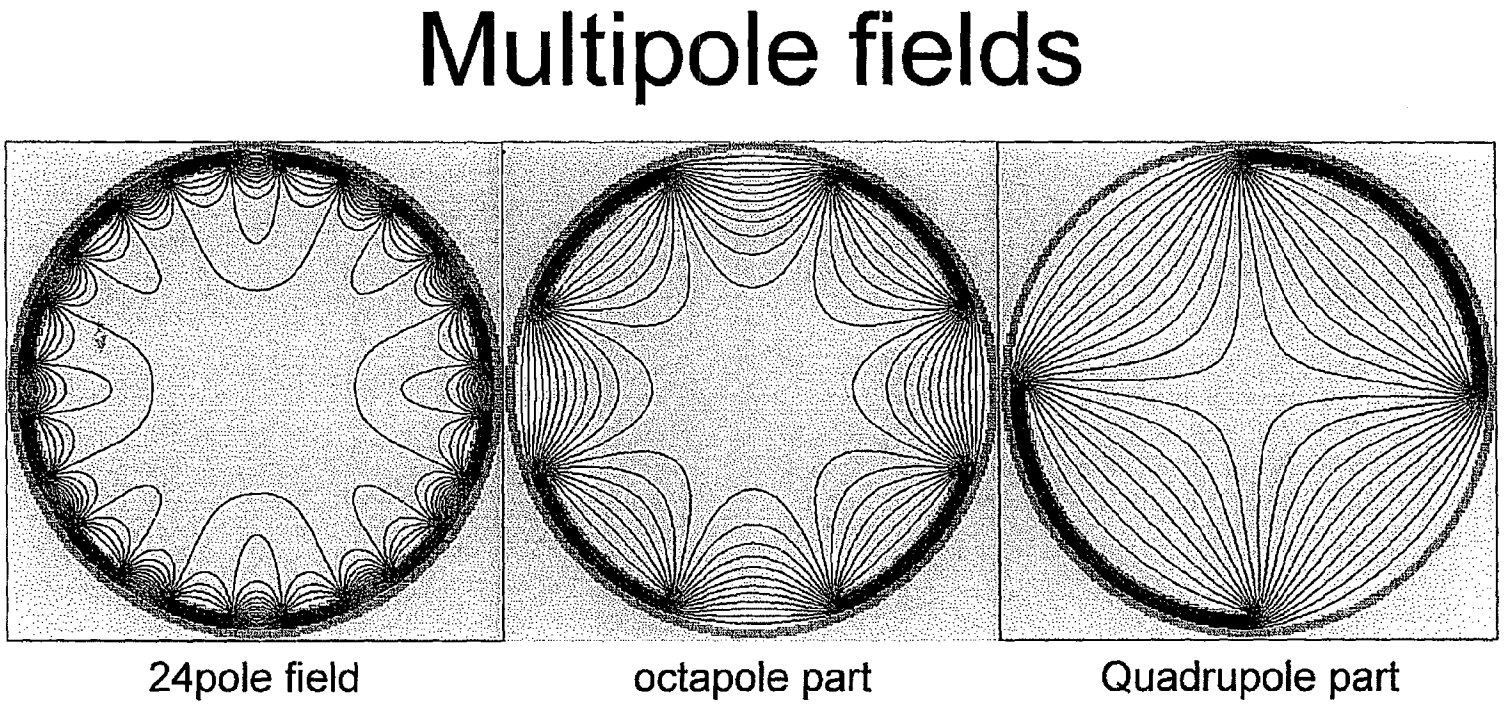
FIG. 4 shows multiple multipole fields RF fields generated by the ion guide of the embodiment of FIG. 3 according to various embodiments of the applicant's teachings.

In various aspects, as exemplified in FIG. 2, the plurality of sections of the inner cylinder 40 can comprise sections. For example, as illustrated in FIG. 2, a first section 44*a* and a second section 44*b* can each comprise a plurality of slots 46*a* and 46*b* respectively for generating the more than one multipole RF field. In various embodiments, for example, the first section can comprise four slots to generate an octopole field and the second section can comprise two slots to generate a quadrupole field. In various embodiments, the length and width of the plurality of slots can be suitably sized to generate the desired multipole field. In various embodiments, the distance between the outer and inner cylinders can be less than the width of the slots. In various embodiments, the distance between the outer and inner cylinders can be about 1 mm. In various embodiments, the thickness of the inner cylinder can be less than the width of the slots. In various embodiments, the thickness of the inner cylinder can be about 0.5 mm to about 1 mm. In various embodiments, the minimum width of the slot can be about 1 mm. In various aspects, FIG. 3, as an example, shows the plurality of sections of the inner cylinder 40 comprising a first section 44*a* having twelve slots 46*a* to generate a $24^{th}$ pole electric field, a second section 44*b* comprising four slots 46*b* to generate an octopole electric field, and a third section 44*c* comprising two slots 46*c* to generate a quadrupole electric field; the slots are represented by the shaded areas. Reference is made to FIG. 4 which exemplifies the multiple multipole RF fields, a $24^{th}$ pole electric field, an octopole field, and a quadrupole field, that can be generated in each section of the at least one ion guide of FIG. 3.

In various embodiments, the inner cylinder can be comprised of a conductive material and, in various aspects, can comprise of, but is not limited to, brass. In various embodiments, the outer cylinder can be comprised of a conductive material and, in various aspects, can comprise of, but is not limited to, stainless steel. In various embodiments, the outer cylinder can be solid. In various embodiments, the outer cylinder can be meshed for better vacuum pumping. In various embodiments, the thickness of the inner and outer cylinders can vary. In various embodiments, the thickness of the inner cylinder can be less than the width of the slots. In various embodiments, the thickness of the inner cylinder can be about 0.5 mm to about 1 mm. In various embodiments, the minimum width of the slot can be about 1 mm.

In various embodiments, the length of the inner cylinder can be suitable to generate the desired multipole field. In various embodiments, the length of the outer cylinder can be suitable to generate the desired multipole field. In various embodiments, the length of the inner cylinder can be longer than 10 mm. In various embodiments, the length of the inner cylinder can be about 50 mm to about 200 mm. In various embodiments, the length of the outer cylinder can be about 50 mm to about 200 mm.

Figure 5:
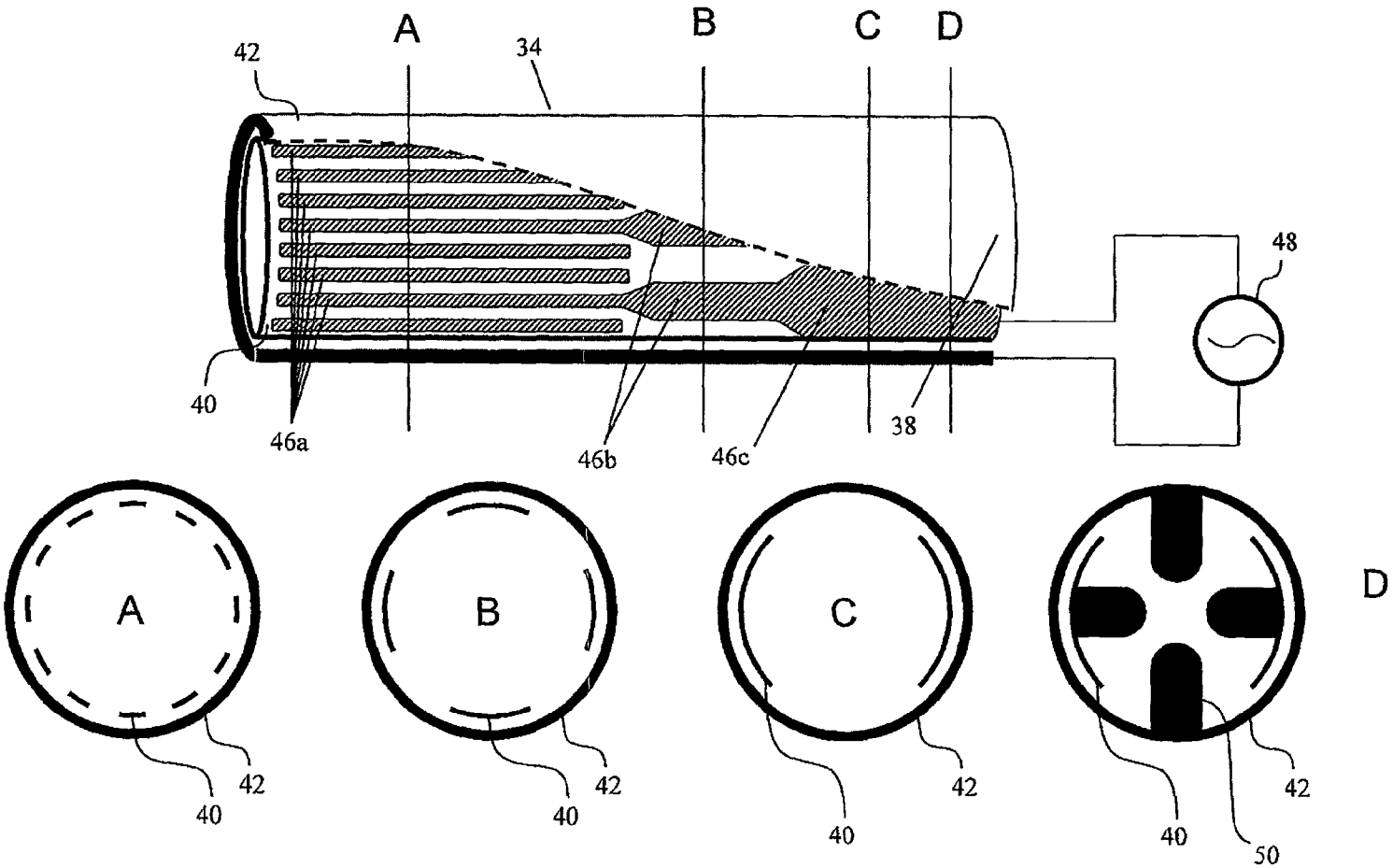
FIG. 5 is a cross-sectional view of an ion guide according to various embodiments of the applicant's teachings.
Figure 6:
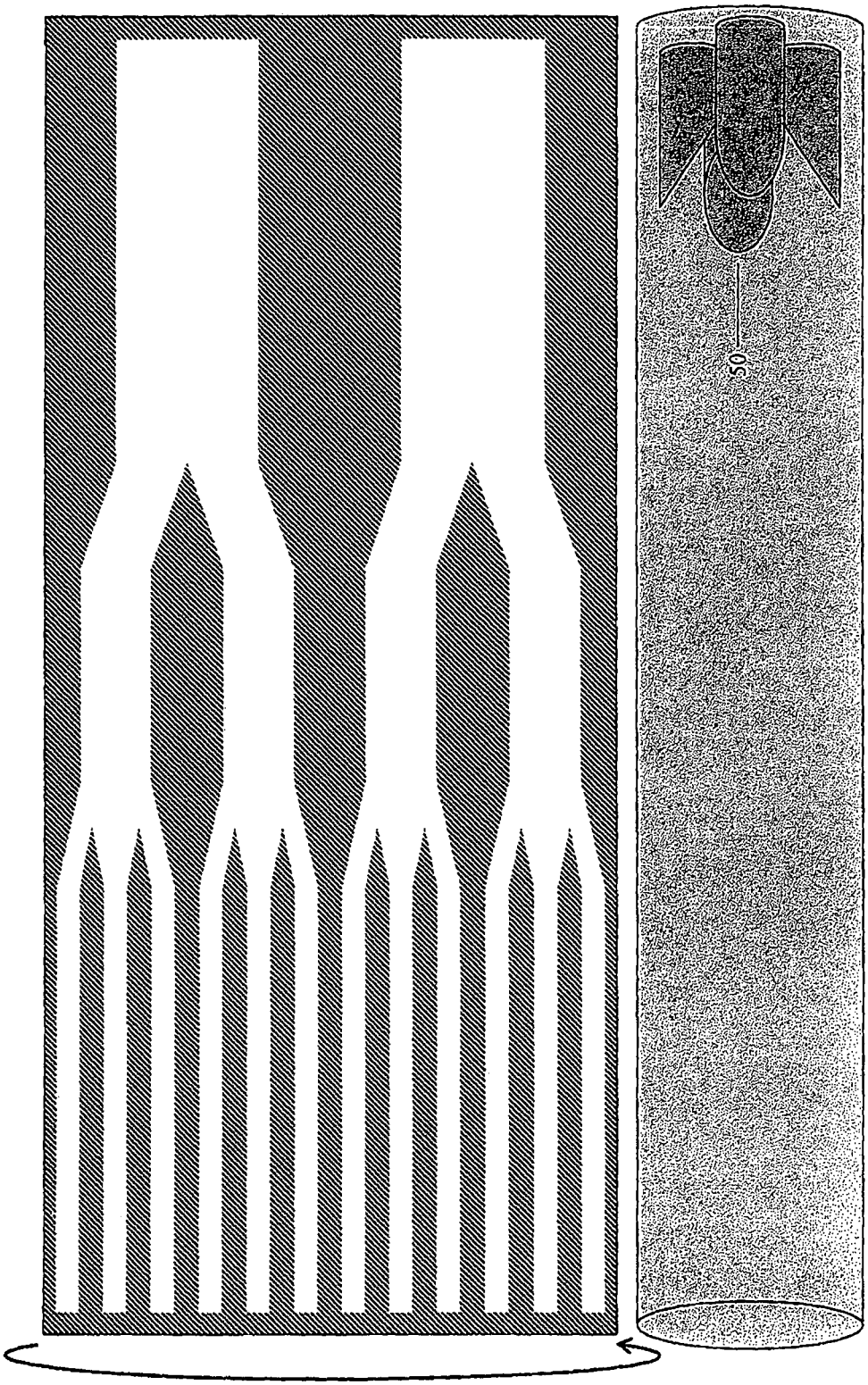
FIG. 6 is a schematic view of an ion guide according to various embodiments of the applicant's teachings.

In various aspects, there is provided at least one ion guide 34 as exemplified in FIG. 5. The at least one ion guide 34 can comprise an inner cylinder 40 and an outer cylinder 42. In this example, the inner cylinder comprises a plurality of sections, A, B, and C. Each of the plurality of sections of the inner cylinder can comprise a different number of slots 46*a*, 46*b*, etc. represented by the shaded areas. In various embodiments, the number of slots in each section of the inner cylinder can be determined by n/2, where n is the order of the multipole RF field generated. In various aspects, the inner cylinder can be coaxially disposed within the outer cylinder. Section D of the inner cylinder 40 near the exit end 38 of the at least one ion guide 34 can further comprise additional quadrupole electrodes 50 to generate a stronger quadrupole field. Reference is made to FIG. 6 which also exemplifies at least one ion guide comprising additional electrodes 50. In various embodiments, the additional quadrupole electrodes 50 can be located anywhere within the at least one ion guide 34. In various embodiments, RF voltage 48 can be applied to the additional quadrupole electrodes 50. In various aspects, other configurations containing electrodes of different shapes can also be possible.

Figure 7:
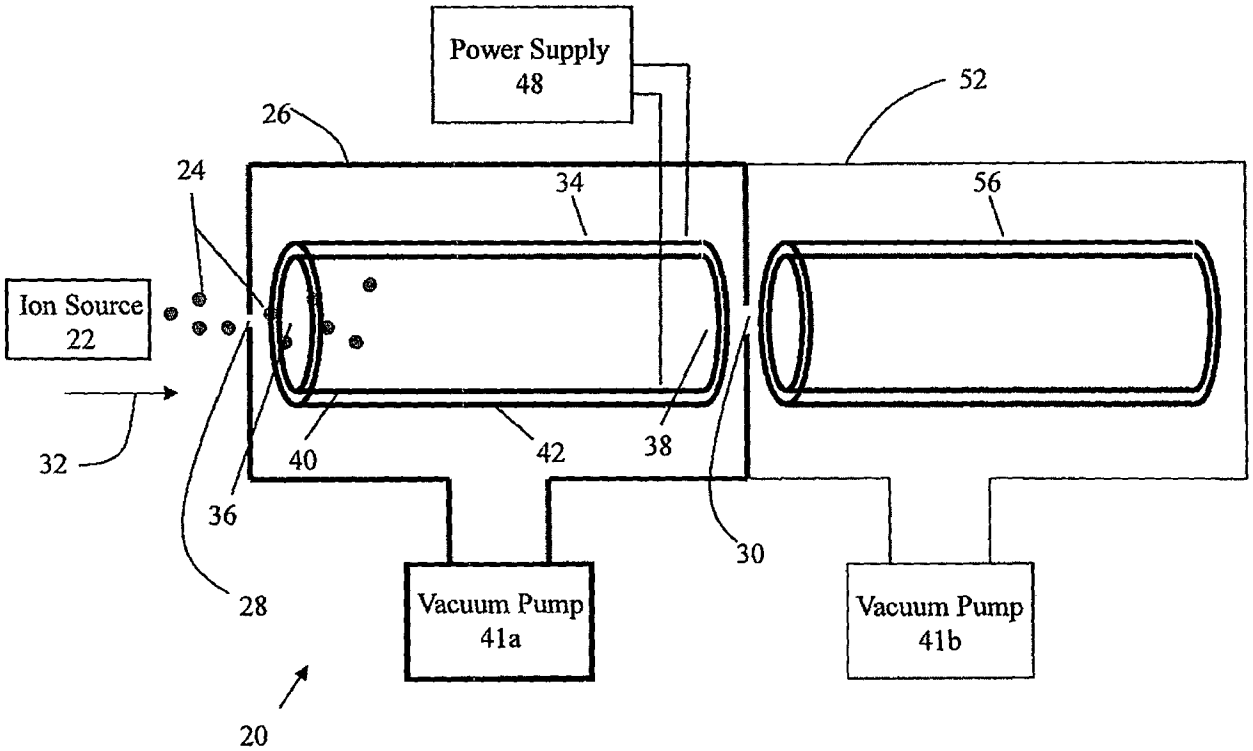
FIG. 7 is a schematic view of a series of ion guides according to various embodiments of the applicant's teachings.

In various embodiments, the at least one ion guide can comprise more than one ion guide. In various aspects, each ion guide can be configured to generate more than one multipole RF field. In various aspects, the at least one ion guide can comprise a series of multipole ion guides. For example, reference is made to FIG. 7 which shows a first 34 and a second 56 multipole ion guide. In FIG. 7, common elements have the same reference numerals as in FIG. 1 and for brevity the description of these common elements, already described above, has not been repeated. In various aspects, each ion guide in the series of multipole ion guides can be configured to generate more than one multipole field. In this example, two ion guides 34 and 56 define the series, however, the series of ion guides can comprise more than two ion guides.

In various aspects, the ions 24 can enter the chamber 26 through an inlet aperture 28 which receives the ions 24, where the ions are entrained by a supersonic flow of gas, typically referred to as a supersonic free jet expansion as described, for example, in applicant's U.S. Pat. Nos. 7,256,395 and 7,259,371 herein incorporated by reference. In various embodiments, the length of a first section of the at least one ion guide when configured to generate a $24^{th}$ pole field can be as long as the Mach disk or shorter to avoid air with high velocity, such as the free jet of air from the orifice, passing through lower multipole regions, such as an octopole or a quadrupole.

In various embodiments, a method for producing or manufacturing at least one multiple multipole ion guide is provided. The method can comprise of producing an inner cylinder and an outer cylinder. In various aspects, the inner cylinder can comprise a plurality of sections. In various embodiments, each section can be machined to form a different number of slots to generate more than one multipole RF field in the at least one ion guide. Each of the plurality of sections of the inner cylinder can comprise a different number of slots. In various embodiments, the number of slots in each section of the inner cylinder can be determined by n/2, where n is the order of the multipole RF field generated. In various embodiments, the inner cylinder can be integrally formed. In various aspects, the outer cylinder can be meshed. In various aspects, the inner cylinder can be configured to be coaxially disposed within the outer cylinder. In various embodiments, the thickness of the inner and outer cylinders can vary. In various embodiments, the thickness of the inner cylinder can be less than the width of the slots. In various embodiments, the thickness of the inner cylinder can be about 0.5 mm to about 1 mm. In various embodiments, the minimum width of the slot can be about 1 mm. In various embodiments, the length of the inner cylinder can be suitable to generate the desired multipole field. In various embodiments, the length of the outer cylinder can be suitable to generate the desired multipole field. In various embodiments, the length of the inner cylinder can be longer than 10 mm. In various embodiments, the length of the inner cylinder can be about 50 mm to about 200 mm. In various embodiments, the length of the outer cylinder can be about 50 mm to about 200 mm.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicants' teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations are believed to be within the sphere and scope of the invention.

The invention claimed is:

1. A mass spectrometer system, comprising:

an ion source for generating ions from a sample;

a vacuum chamber comprising an inlet aperture for receiving the ions, and an exit aperture for passing ions from the vacuum chamber;

at least one ion guide between the inlet and exit apertures, the at least one ion guide having an entrance end and an exit end;

the at least one ion guide comprising an inner cylinder and an outer cylinder, the inner cylinder having a plurality of sections, each section comprising a plurality of slots in the inner cylinder and each of the plurality of sections of the inner cylinder comprises a different number of slots, the inner cylinder coaxially disposed within the outer cylinder, wherein the inner cylinder is configured to generate more than one multipole RF field; and a power supply for providing an RF voltage between the outer and inner cylinders for radially confining the ions within the inner cylinder of the at least one ion guide.

2. The system of claim 1 wherein the number of slots is determined by n/2, where n is the order of the multipole RF field generated.

3. The system of claim 2 wherein the number of slots in the plurality of sections of the inner cylinder is selected from the group consisting of two slots to generate a quadrupole electric field, three slots to generate a hexapole electric field, four slots to generate an octopole electric field, and any combinations thereof.

4. The system of claim 1 wherein the plurality of sections of the inner cylinder comprise a first section and a second section, each section having a plurality of slots for generating the more than one multipole RF field.

5. The system of claim 4 wherein the first section comprises four slots to generate an octopole field and the second section comprises two slots to generate a quadrupole field.

6. The system of claim 1 wherein the outer cylinder is meshed.

7. The system of claim 1 wherein the plurality of slots is suitably spaced to generate the desired more than one multipole field.

8. The system of claim 1 wherein the length of the inner cylinder is suitable to generate the desired more than one multipole field.

9. The system of claim 1 wherein the length of the outer cylinder is suitable to generate the desired more than one multipole field.

10. The system of claim 1 wherein a section of the inner cylinder at the exit end of the at least one ion guide further comprises additional quadrupole electrodes to generate a stronger quadrupole field.

11. A method for transmitting ions comprising:

providing an ion source for generating ions from a sample;

providing a vacuum chamber comprising an inlet aperture for receiving the ions, and an exit aperture for passing ions from the vacuum chamber;

providing at least one ion guide between the inlet and exit apertures, the at least one ion guide having an entrance end, a predetermined entrance cross-section defining an internal volume, and an exit end;

providing the at least one ion guide comprising an inner cylinder and an outer cylinder, the inner cylinder having a plurality of sections comprising a plurality of slots and each of the plurality of sections of the inner cylinder comprises a different number of slots, the inner cylinder coaxially disposed within the outer cylinder, wherein the inner cylinder is configured to generate more than one multipole RF field; and providing a power supply for providing an RF voltage between the outer and inner cylinders for radially confining the ions within the inner cylinder of the at least one ion guide.

12. The method of claim 11 wherein the number of slots is determined by n/2, where n is the order of the multipole RF field generated.

13. The method of claim 12 wherein the number of slots in the plurality of sections of the inner cylinder is selected from the group consisting of two slots to generate a quadrupole electric field, three slots to generate a hexapole electric field, four slots to generate an octopole electric field, and any combinations thereof.

14. The method of claim 11 wherein the plurality of sections of the inner cylinder comprise a first section and a second section, each section having slots for generating the more than one multipole RF field.

15. The method of claim 14 wherein the first section comprises four slots to generate an octopole field and the second section comprises two slots to generate a quadrupole field.

16. The method of claim 11 wherein the outer cylinder is meshed.

17. The method of claim 11 wherein the plurality of slots is suitably spaced to generate the desired multipole field.

18. The method of claim 11 wherein the length of the inner cylinder is suitable to generate the desired more than one multipole field.

19. The method of claim 11 wherein the length of the outer cylinder is suitable to generate the desired more than one multipole field.

20. The method of claim 11 wherein a section of the inner cylinder at the exit end of the at least one ion guide and a corresponding section of the outer cylinder at the exit end of the at least one ion guide comprises additional electrodes to generate a stronger quadrupole field.

* * * * *